US006497122B2

(12) United States Patent
Held et al.

(10) Patent No.: US 6,497,122 B2
(45) Date of Patent: Dec. 24, 2002

(54) DRUM-TYPE FABRIC DYEING MACHINE

(75) Inventors: Jürgen Held, Iserlohn (DE); Frank Krämer, Iserlohn (DE)

(73) Assignee: Bam Anlagen und Maschinen GmbH + Co. KG, Hagen (DE)

( * ) Notice: Subject to any disclaimer, the term of this patent is extended or adjusted under 35 U.S.C. 154(b) by 76 days.

(21) Appl. No.: 09/875,821

(22) Filed: Jun. 6, 2001

(65) Prior Publication Data

US 2002/0017118 A1 Feb. 14, 2002

(30) Foreign Application Priority Data

Jun. 17, 2000 (DE) ..... 100 30 008

(51) Int. Cl.[7] ..... D06B 5/22
(52) U.S. Cl. ..... 68/58; 68/145
(58) Field of Search ..... 68/58, 143, 145, 68/27

(56) References Cited

U.S. PATENT DOCUMENTS 1,862,652 A * 6/1932 Balzer ..... 68/143
3,344,447 A * 10/1967 Cnador et al. ..... 68/58 X

FOREIGN PATENT DOCUMENTS

DE 44 09 575 3/1995

* cited by examiner

*Primary Examiner*—Philip Coe
(74) *Attorney, Agent, or Firm*—Herbert Dubno

(57) ABSTRACT

A drum-type fabric dyeing machine has its drum subdivided into sections by radial partitions. The partitions are connected to the drum wall by narrow perforated strips through which the dyeing liquor is discharged. The drum wall and the partition are unperforated. The partitions are connected to a perforated pipe at the center of the drum through which the dyeing liquor is introduced.

19 Claims, 2 Drawing Sheets

DRUM-TYPE FABRIC DYEING MACHINE

FIELD OF THE INVENTION

Our present invention relates to a drum-type dyeing machine for the dyeing textiles or other fabric workpieces. More particularly, the invention relates to a drum-type fabric dyeing machine in which the dyeing liquor or solution is supplied to the drum through a perforated pipe and in which the interior of the drum is subdivided by partitions into segments. The invention also relates to a drum for such a dyeing machine.

BACKGROUND OF THE INVENTION

A drum-type fabric dyeing machine is described, for example in German Patent DE 44 09575 C1. Such a dyeing machine can include a machine housing, a drum rotatable about a preferably horizontal axis in the machine housing, a closable filling opening for the drum and the aforementioned pipe provided with holes and referred to herein as a perforated pipe, which runs coaxial with the axis and serves to introduce the dyeing liquor or solution to the drum.

A dyeing liquor outlet is provided from the space surrounding the drum and the interior of the drum can be provided with partition walls which are connected to the pipe and subdivide the interior of the drum into the segments.

Drum type dyeing machines of this kind are widely used and the interior of the drum can be subdivided, for example, by three equipspaced partitions into segments. The partitions as well as the drum wall are perforated or provided with holes so that the dyeing liquor, introduced centrally into the drum, can disperse through the textile pieces in the drum and can contact them well with a suitable dyeing effect. The dye liquor can then be discharged through the perforations of the drum and then drawn off and if desired replenished and recycled. Such drum-type dyeing machines are not particularly suitable for sensitive fabrics since such fabrics can hang up on the perforations of the partitions and the outer shell of the drum and hence the fabric can be damaged. In addition, as a result of the capture by the holes of the fabric articles, the dynamic movement of the dyeing liquor is limited or obstructed and hence the dyeing effect can be unsatisfactory.

OBJECTS OF THE INVENTION

It is the principal object of the present invention to provide an improved drum-type fabric dyeing machine which can be used effectively even for sensitive fabrics and is less prone to damaging the fabric and to interfering with the dyeing solution dynamics than has hitherto been the case.

Another object of this invention is to provide a dyeing machine which overcomes the drawbacks of earlier fabric dyeing machines of the drum type.

Still another object of the invention is to provide an improved drum for a fabric dyeing machine.

SUMMARY OF THE INVENTION

These objects and others which will become apparent hereinafter are attained, in accordance with the invention, by providing the partitions and the drum wall of unperforated material and by forming the connections between the drum walls and the partitions at least on one side of each partition but preferably on both sides of each partition as narrow perforated strips which serve as the dye liquor discharge regions. The term "perforated" and terms of similar meaning are intended to refer to material, e.g. stainless steel sheet, which can be formed with openings of any size and configuration. These can be circular holes, elongated holes, slits or openings of other shapes.

More particularly, a drum-type fabric dyeing machine according to the invention can comprise:

a machine housing;

a dyeing drum rotatable in the housing about an axis and having a closable filling opening for introducing fabric to be dyed into the drum and removing dyed fabric from the drum, the drum having a nonperforated drum wall surrounding the axis;

a pipe provided with a multiplicity of holes extending in the drum along the axis and coaxial with the drum for distributing a dyeing liquor in the drum;

means for collecting dyeing liquor from the drum;

a plurality of radial nonperforated partitions within the drum connected to the pipe and subdividing an interior of the drum into segments; and perforated strips of widths which are small relative to widths of the partitions interconnecting at least one side of each of the partitions with the drum wall and discharging the dyeing liquor from the drum.

Since the partition and the drum wall or shell are of smooth unperforated material, e.g. stainless steel sheet, damage to fabrics, for textiles introduced into the drum need not be feared. Damage in the region of the perforated pipe forming the solution-inlet unit need not be a problem since rotation of the drum displaces the textile material outwardly so that the fabric will not come into contact with the perforated pipe.

However, to allow the solution to be discharged from the drum, the narrow perforated regions of the steel material are provided. When the drum is rotatable only in one rotation these strips need only be provided on one side of the partition. However, when the drum is oscillated back and forth or rotated in both rotational senses it is found to be advantageous to provide the strips on both sides of the partition. The perforated regions function as solution-discharge regions and, according to the invention there are only limited regions in which the perforations or holes are provided and which could possibly damage the fabric. However, by providing these strips so that they extend inwardly to the respective partitions, the strips interact with the solution to promote a dynamic movement which contributes to preventing the fabric from hanging up on the perforations even though they are limited in number, and the perforated strips in addition promote an effective dynamic flow of the solution out of the drum.

Preferably the perforated strip has a width which is smaller than a third of the drum diameter and still more advantageously is less than a sixth thereof. The perforated strip should be angled radially inwardly from the drum wall or shell so that between the strip and the drum wall an obtuse angle is formed. This has been found to facilitate the runoff of the solution through the perforated region and also ensures a high quality of the dyeing fabric. It is also conceivable to cover the perforated region by overlying diaphragm or shutter strips so that only a narrow gap remain through which only the dyeing liquor can be discharged and thereby protecting the perforated region or the angled region from contact with the fabric behind the gap.

The angled perforated region can include an obtuse angle with the respective partition. Each perforated region can form a radially inwardly projecting channel or corrugation extending parallel to the drum axis and connected to the repsective partition. To avoid damage to the fabric to be dyed, the transitions from the partitions to the perforated regions and from the perforated regions to the drum wall can be radiused or rounded without sharp edges.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
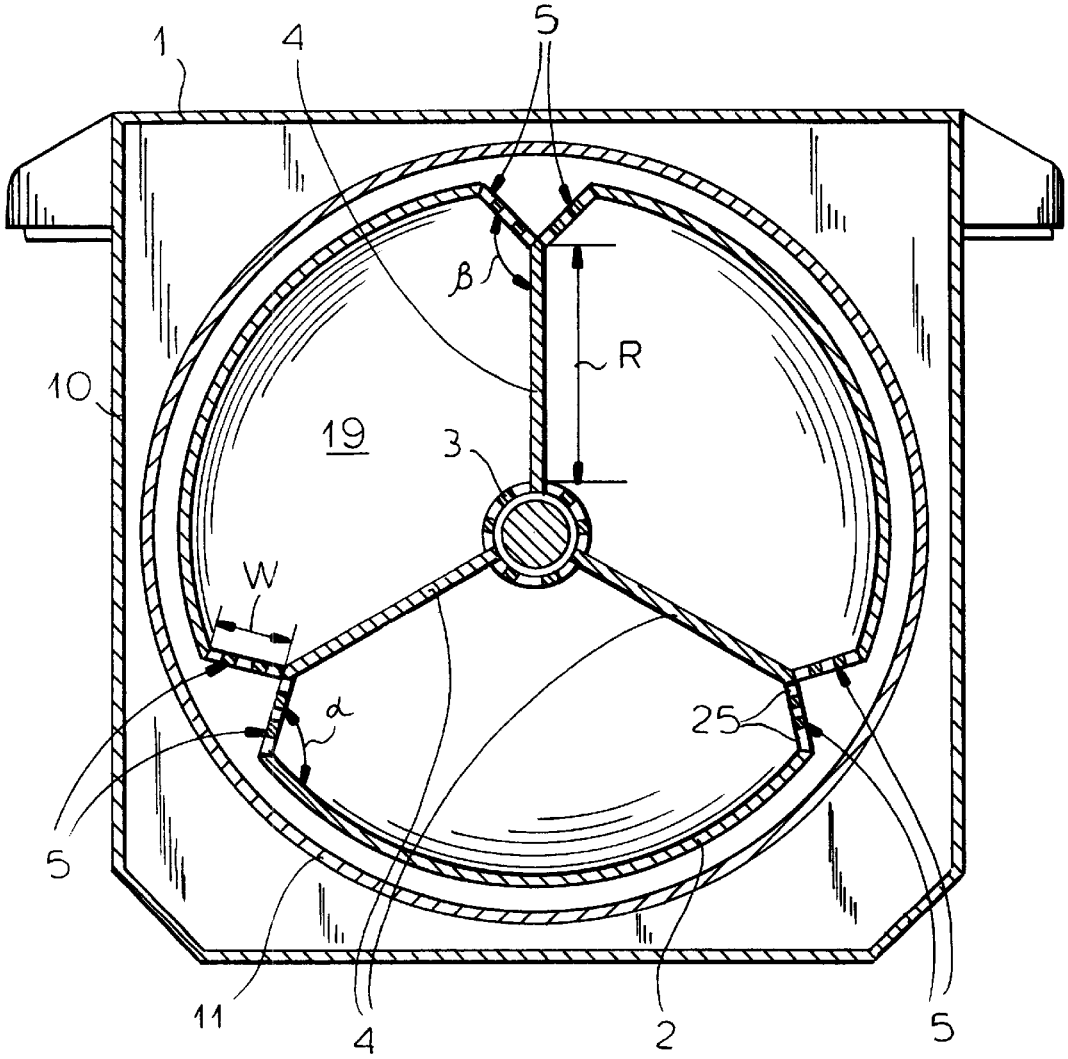
FIG. 1 is a cross sectional view through a drum-type fabric dyeing machine seen in the axial direction.
Figure 4:
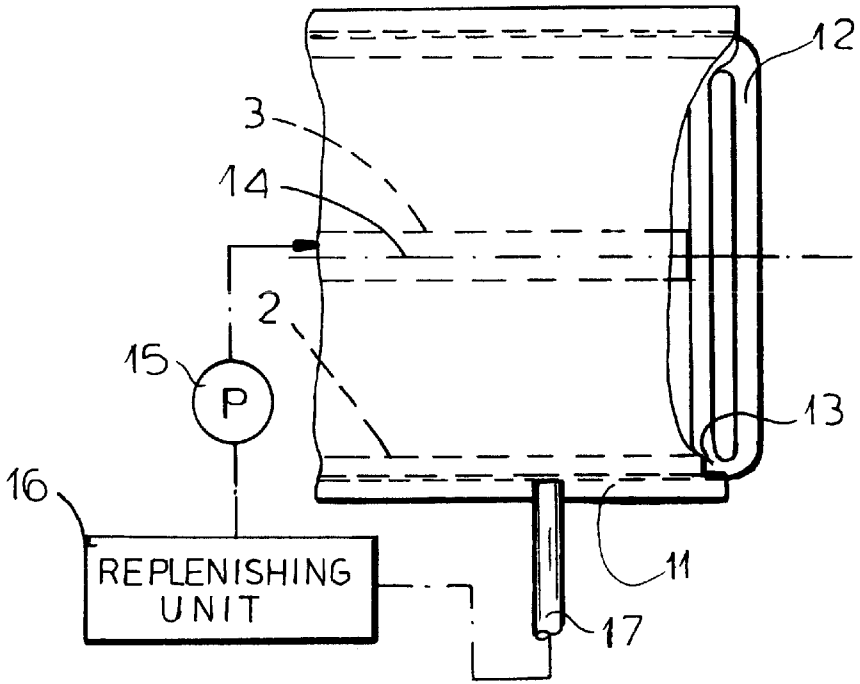
FIG. 4 is a diagrammatic side elevational view partly broken away of a portion of the machine of the invention.

FIG. 1 shows a drum-type dyeing machine 1 for the dyeing of textile fabrics, garments or the like having a machine housing 10 in which a cylindrical casing 11 is mounted and a drum 2 rotatable in the casing 11 about a horizontal axis. As can be seen from FIG. 4, the housing can have a door 12 which can be fitted over a filling opening 13 in the drum 2 at an end thereof.

To enable the dyeing liquor to be fed to the drum 2, a dyestuff supply unit is provided which can include the perforated pipe 3 oriented coaxial with the drum 2 and along the horizontal axis 14 thereof (FIG. 4) the pipe 3 can rotate with the drum. The pipe 3 is supplied with the dyeing liquor by a pump 15 from the replenishing unit 16 which draws the depleted dyestuff from a pipe 17 forming an outlet for the casing 11.

The interior of the drum 2, i.e. the spacing surrounded by the drum wall, is subdivided by radially oriented portions 4 connected to the pipe 3 into segments 19 (FIG. 1).

Figure 3:
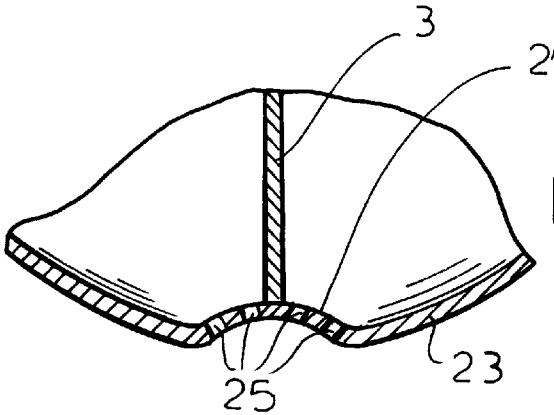
FIG. 3 is a detail showing a perforated region as a trough.
Figure 2:
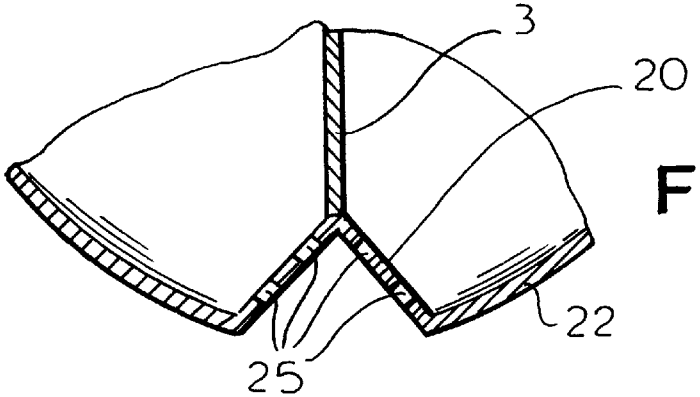
FIG. 2 is a detail showing a perforated region formed as a corrugation.

The portions 4 and the wall of the drum are constituted of unperforated smooth material, for example steel or stainless steel sheet. The drum wall is connected, on both sides of each partition 4 with a pair of narrow perforated strips 5 which run parallel to the axis 14 and are welded to the drum wall and the partition 4. The width W of each strip 5 can be less than one-sixth of the width R of the partition. The perforated strips 5 extend radially inwardly at angles $\alpha$ to the wall of the drum which are obtuse angles as are the angles $\beta$ between these strips and the respective partition 4. As has been shown in FIGS. 2 and 3, the perforated strips may be formed as corrugations 20 or channels 21 formed directly in the drum walls 22 and 23. The danger of damage to the fabric is eliminated and a dynamic movement of the dyeing liquor upon rotation of the drum is ensured. The discharge of the dyeing liquor is effected through the perforated strips which are holes 25 for the discharge of the liquid.

We claim:

1. A drum-type fabric-dyeing machine comprising:

a machine housing;

a dyeing drum rotatable in said housing about an axis and having a closable filling opening for introducing fabric to be dyed into said drum and removing dyed fabric from said drum, said drum having a nonperforated drum wall surrounding said axis;

a pipe provided with a multiplicity of holes extending in said drum along said axis and coaxial with said drum for distributing a dyeing liquor in said drum;

means for collecting dyeing liquor from said drum;

a plurality of radial nonperforated partitions within said drum connected to said pipe and subdividing an interior of said drum into segments; and perforated strips of widths which are small relative to widths of said partitions interconnecting at least one side of each of said partitions with said drum wall and discharging said dyeing liquor from said drum.

2. The drum-type fabric-dyeing machine defined in claim 1 wherein each of said strips extends from said drum wall inwardly toward said axis.

3. The drum-type fabric-dyeing machine defined in claim 2 wherein the width of each of said strips is less than a third of a diameter of said drum.

4. The drum-type fabric-dyeing machine defined in claim 3 wherein the width of each of said strips is less than a sixth of said diameter of said drum.

5. The drum-type fabric-dyeing machine defined in claim 1 wherein each of said strips is inclined inwardly from said drum wall at an obtuse angle toward said axis.

6. The drum-type fabric-dyeing machine defined in claim 1 wherein each of said strips adjoins the respective partition at an obtuse angle.

7. The drum-type fabric-dyeing machine defined in claim 1 wherein a respective one of said perforated strips is provided on each side of each of said partitions.

8. The drum-type fabric-dyeing machine defined in claim 1 wherein each of said strips forms a corrugation in said drum wall extending parallel to said axis and to which a respective one of said partitions is connected.

9. The drum-type fabric-dyeing machine defined in claim 1 wherein each of said strips forms a channel in said drum wall extending parallel to said axis and to which a respective one of said partitions is connected.

10. The drum-type fabric-dyeing machine defined in claim 1 wherein transitions between said partitions and said strips and between said strips and said drum wall are rounded.

11. A drum for a drum-type fabric-dyeing machine having an axis of rotation, a closable filling opening for introducing fabric to be dyed into said drum and removing dyed fabric from said drum, and a nonperforated drum wall surrounding said axis, said drum being provided with a pipe formed with a multiplicity of holes extending in said drum along said axis and coaxial with said drum for distributing a dyeing liquor in said drum, a plurality of radial nonperforated partitions being provided within said drum connected to said pipe and subdividing an interior of said drum into segments, and perforated strips of widths which are small relative to widths of said partitions interconnecting at least one side of each of said partitions with said drum wall and adapted to discharge said dyeing liquor from said drum.

12. The drum defined in claim 11 said drum has a horizontal axis and the width of each of said strips is less than a third of a diameter of said drum.

13. The drum defined in claim 12 wherein the width of each of said strips is less than a sixth of said diameter of said drum.

14. The drum defined in claim 13 wherein each of said strips is inclined inwardly from said drum wall at an obtuse angle toward said axis.

15. The drum defined in claim 14 wherein each of said strips adjoins the respective partition at an obtuse angle.

16. The drum defined in claim 15 wherein a respective one of said perforated strips is provided on each side of each of said partitions.

17. The drum defined in claim 16 wherein each of said strips forms a corrugation in said drum wall extending parallel to said axis and to which a respective one of said partitions is connected.

18. The drum defined in claim 16 wherein each of said strips forms a channel in said drum wall extending parallel to said axis and to which a respective one of said partitions is connected.

19. The drum defined in claim 18 wherein transitions between said partitions and said strips and between said strips and said drum wall are rounded.

* * * * *